US005796319A

United States Patent [19]

Kich

[11] Patent Number: 5,796,319

[45] Date of Patent: Aug. 18, 1998

[54] DUAL MODE CAVITY RESONATOR WITH COUPLING GROOVES

[75] Inventor: Rolf Kich, Redondo Beach, Calif.

[73] Assignee: Hughes Electronics Corporation, Los Angeles, Calif.

[21] Appl. No.: 920,103

[22] Filed: Aug. 26, 1997

[51] Int. Cl.[6] ..... H01P 1/207

[52] U.S. Cl. ..... 333/208; 333/212; 333/230

[58] Field of Search ..... 333/21 A, 208, 333/209, 212, 227, 230

[56] References Cited

U.S. PATENT DOCUMENTS

| | | | |
|---|---|---|---|
| 3,758,882 | 9/1973 | Mörz | 333/21 A |
| 4,498,061 | 2/1985 | Mörz et al. | 333/212 X |
| 4,513,264 | 4/1985 | Dorey et al. | 333/209 X |
| 4,523,160 | 6/1985 | Ploussios | 333/21 A |

FOREIGN PATENT DOCUMENTS

| | | | |
|---|---|---|---|
| 60-174501 | 9/1985 | Japan | 333/212 |

*Primary Examiner*—Seungsook Ham

*Attorney, Agent, or Firm*—T. Gudmestad; M. W. Sales

[57] ABSTRACT

An electromagnetic resonator comprises an interior wall defining a substantially cylindrical cavity having a major axis. The interior wall includes first and second coupling grooves substantially parallel to the major axis. For a lesser level of coupling, the coupling grooves may be shorter than the length of the resonator and/or the second coupling groove may be omitted.

8 Claims, 2 Drawing Sheets

DUAL MODE CAVITY RESONATOR WITH COUPLING GROOVES

BACKGROUND OF THE INVENTION (a) Field of the Invention

The present invention relates generally to waveguide resonators used in electromagnetic filters and, more particularly, to dual mode cavity resonators for coupling electromagnetic signals having orthogonal field orientations (modes).

(b) Description of Related Art

Dual mode cavity resonators are used in devices such as multiplexers and demultiplexers in microwave receivers and transmitters for coupling electromagnetic signals having two orthogonal modes. Typically, a dual mode cavity resonator includes a coupling screw that passes through a threaded hole in the wall of the resonator at a radial position 45 degrees offset from the orientation of one of the orthogonal electromagnetic signals for which the resonator is tuned. If two coupling screws are used instead of one coupling screw, for example, to augment the amount of coupling, the first screw and second screw are positioned 180 degrees apart from one another.

Although simple and straightforward from a design and manufacturing standpoint, the use of coupling screws has numerous drawbacks. The threads in the coupling screws and in the resonator wall can cause passive intermodulation (PIM) effects, for example, due to light contact and/or incomplete contact between portions of the threads in the coupling screws and the threads in the resonator wall. Also, coupling screws can limit filter bandwidth due to the disruption of field symmetry, especially where coupling screw penetration into the resonator cavity is relatively large. For high frequency filters operating in a range of from about 30 GHz to about 60 GHz, the coupling screws are very small (e.g., size 00-96 or 000-120) and difficult to work with, making filter tuning difficult if not impossible to accomplish.

An alternative to the use of coupling screws is disclosed in Gray, U.S. Pat. No. 5,418,510, entitled "Cylindrical Waveguide Resonator Filter Section Having Increased Bandwidth," the disclosure of which is hereby incorporated by reference. The resonator disclosed in the Gray '510 patent has bars disposed on the interior surface of the resonator, instead of coupling screws. Each bar extends over substantially the entire length of the resonator.

A disadvantage of the resonator configuration disclosed in the Gray '510 patent is that it is difficult and expensive to manufacture. In order to minimize the cost of machining the bars in the resonator, it is desirable to employ large diameter cutters. However, the use of large diameter cutters results in large radii at the edges of each bar. These large radii result in an ill-defined bar yielding poor coupling performance. Eliminating the large radii requires an additional expensive machining step, such as electron discharge machining.

Accordingly, there is a need for an electromagnetic resonator configured so as to minimize or eliminate the aforementioned problems.

SUMMARY OF THE INVENTION

In accordance with one aspect of the present invention, an electromagnetic filter comprises a resonator having an interior wall defining a substantially cylindrical cavity having a major axis, and a source of electromagnetic energy. The interior wall includes an indentation therein for coupling electromagnetic energy from a first mode to a second mode.

Preferably, the interior wall further includes a second indentation therein for coupling electromagnetic energy from the first mode to the second mode.

In accordance with another aspect of the present invention, an electromagnetic filter includes a resonator with a substantially cylindrical cavity having an interior wall and a major axis. The interior wall includes a first coupling groove therein, substantially parallel to the major axis, for coupling electromagnetic energy from a first mode to a second mode.

A resonator in accordance with the present invention may be manufactured easily using large diameter cutters and does not require additional machining steps for attaining satisfactory performance. With a resonator in accordance with the present invention, PIM effects are minimized while at the same time a wide bandwidth is achieved. Also, asymmetric effects due to deep coupling screw penetration are eliminated, as tuning screws, if used at all, need only penetrate a small amount into the resonator cavity when used in conjunction with the coupling grooves of the present invention.

The invention itself, together with further objects and attendant advantages, will best be understood by reference to the following detailed description, taken in conjunction with the accompanying drawings.

DESCRIPTION OF THE PREFERRED EMBODIMENTS

Figure 1:
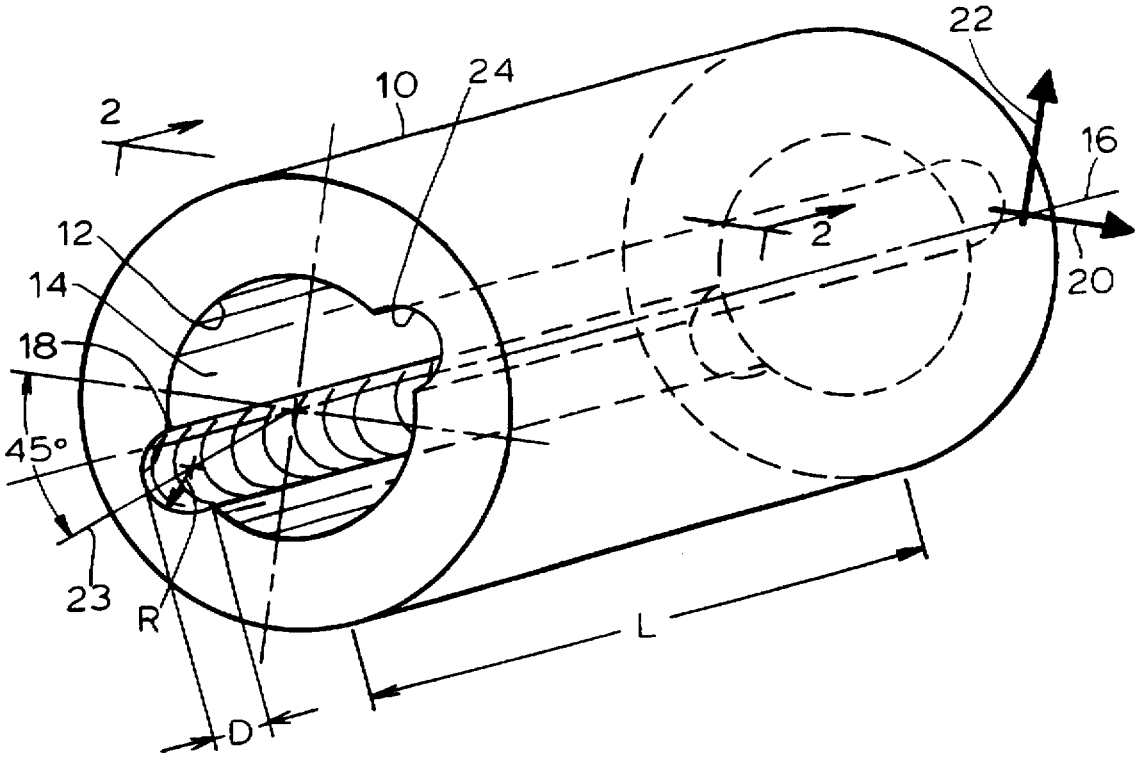
FIG. 1 is a perspective view of a cavity resonator having two coupling grooves in accordance with the present invention.

Referring now to FIG. 1, an electromagnetic resonator 10 according to the present invention, for supporting a TE113 mode, electromagnetic wave, or other circularly cylindrical mode electromagnetic waveform, comprises an interior wall 12 defining a substantially cylindrical cavity 14 having a major axis 16. Either end of the resonator 10 may serve as an input for receiving electromagnetic energy. The interior wall 12 includes an indentation in the form of a first coupling groove 18, substantially parallel to the major axis 16 and extending substantially over the entire length of the cavity 14. The first coupling groove 18 couples electromagnetic energy from a first E field mode, as represented by a horizontal arrow 20, to a second E field mode, as represented by a vertical arrow 22.

The first coupling groove 18 is centered on a line 23 radially offset by an angle, $\alpha$, of about 45.0 degrees from the orientation of the first mode 20. Since the second mode 22 is orthogonal to the first mode 20, the line 23, about which the first coupling groove 18 is centered, is also offset by about 45.0 degrees from the orientation of the second mode 22. The interior wall 12 further includes a second indentation in the form of a second coupling groove 24, disposed opposite the first coupling groove 18, substantially parallel to the major axis 16 and extending substantially over the entire length of the cavity 14. The second coupling groove 24 augments the coupling of electromagnetic energy from the first mode 20 to the second mode 22.

The first coupling groove 18 and the second coupling groove 24 are each cut in the interior wall 12 using a 0.250" (about 0.635 cm) diameter cutter so that each coupling groove 18, 24 has a radius of curvature, R, of about 0.125" (about 0.318 cm). Each coupling groove 18 and 24 has a depth, D, of about 0.050" (about 0.127 cm), as measured from the bottom of the groove to a plane connecting the edges of the groove. The resonator 10 has an inner diameter, ID, of about 1 and 1/16 inches (about 2.70 cm) and a length, L, of about 1.750 inches (about 4.45 cm).

The first and the second coupling grooves 18, 24 provide a symmetric filter response about a center frequency having a passband bandwidth proportional to the depth of the first and the second coupling grooves 18, 24. Tests of the resonator 10 have shown that it can produce a coupling of 102 MHz at an operating frequency of 12 GHz.

Figure 2:
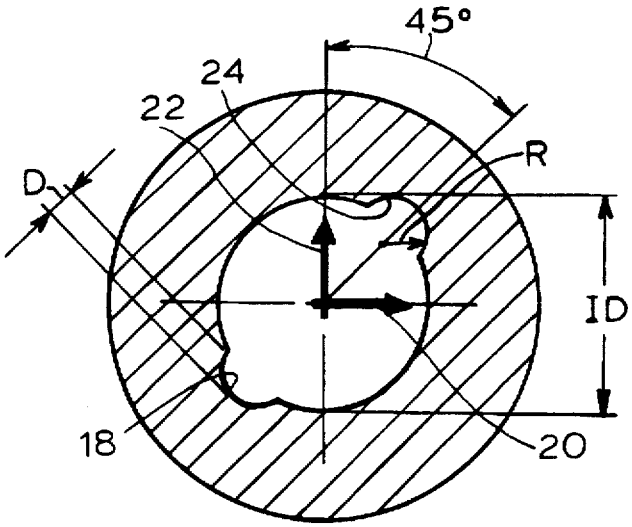
FIG. 2 is a cross-sectional view, taken along lines 2—2 in FIG. 1, of the cavity resonator of FIG. 1.
Figure 3:
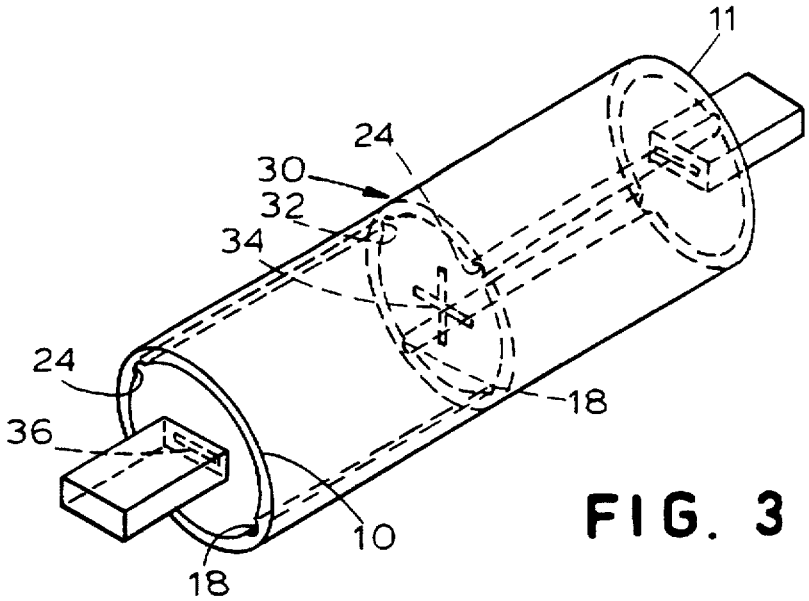
FIG. 3 is a perspective view of a filter comprising two coupled cavity resonators of FIG. 1.

FIG. 3 shows two identical resonators 10, 11 (as shown in FIGS. 1 and 2) coupled together to form a filter, indicated generally at 30. The resonators 10, 11 are angularly offset from one another by 90 degrees from an orientation in which the coupling grooves 18, 24 of each resonator 10, 11 would be aligned. The resonators 10, 11 are coupled together using an iris 32 having a cross-slotted aperture 34. An electromagnetic wave is introduced into the filter 30 via a slotted coupling 36 that is connected to a source of KU band signals (not shown). Although the angular offset magnitude of 90 degrees for adjacent resonators is most common, other angular offset magnitudes are possible.

Figure 4:
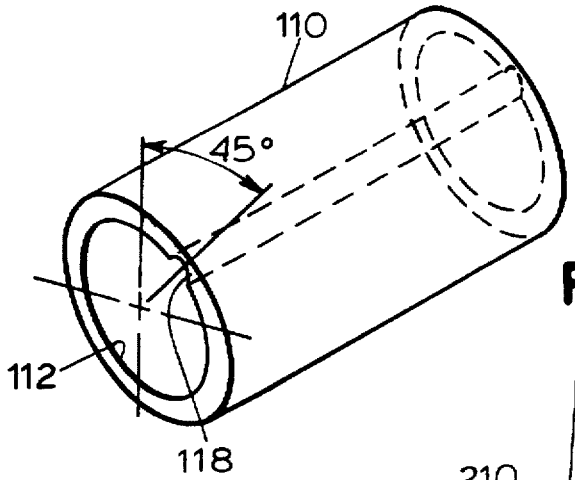
FIG. 4 is a perspective view of a cavity resonator having a single coupling groove in accordance with a first alternative embodiment of the present invention.

A first alternative embodiment of the present invention is shown in FIG. 4. This embodiment comprises a resonator 110 that is identical to that shown in FIGS. 1 and 2, except that, instead of having two coupling grooves, the resonator 110 includes a single coupling groove 118 that is cut in an interior wall 112. The resonator 110 may be used where a lesser level of coupling is desired, as compared to the coupling obtained by the resonator 10 of FIGS. 1 and 2.

Figure 5:
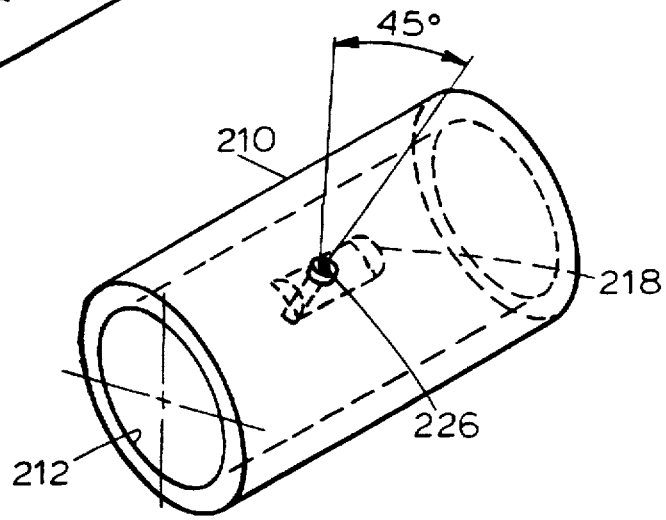
FIG. 5 is a perspective view of a cavity resonator having a partial coupling groove in accordance with a second alternative embodiment of the present invention.

A second alternative embodiment of the present invention is shown in FIG. 5. This embodiment comprises a resonator 210 that is identical to that shown in FIG. 4, except that the resonator 210 includes a partial coupling groove 218, that is cut in an interior wall 212. The partial coupling groove 218 extends over only a portion of the length of the resonator 210. The resonator 210 may be used where a lesser level of coupling is desired, as compared to the coupling obtained by the resonator 110 of FIG. 4. For fine tuning of the coupling level, a tuning screw 226 is provided in the groove 218 of the resonator 210.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention. For example, although not shown in FIGS. 1–4, tuning screws may be used in conjunction with any embodiment of the present invention, for example, at minimum penetration for the purpose of overcoming any tolerance-induced errors in the frequency desired for coupling. Also, in order to increase the level of coupling obtained from the resonator 210, the second alternative embodiment of the invention (FIG. 5) can be modified to include a longer partial coupling groove 218 and/or a second partial coupling groove opposite the partial coupling groove 218. In addition, the number of resonators that are coupled together to form a filter may be increased as desired beyond the two resonators 10, 11 shown in FIG. 3.

What is claimed is:

1. An electromagnetic filter comprising:

a resonator having an interior wall defining a substantially cylindrical cavity having a major axis; and means for introducing electromagnetic energy into the cavity;

wherein the interior wall includes a first coupling groove therein, substantially parallel to the major axis, for coupling the electromagnetic energy from a first mode to a second mode.

2. The electromagnetic filter of claim 1, wherein the cavity is a substantially circular cylindrical cavity.

3. The electromagnetic filter of claim 1, wherein the first mode is orthogonal to the second mode.

4. The electromagnetic filter of claim 1, wherein the cavity has a length along the major axis and the first coupling groove extends along substantially the entire length of the cavity.

5. The electromagnetic filter of claim 1, wherein the interior wall further includes a second coupling groove disposed opposite the first coupling groove.

6. The electromagnetic filter of claim 5, wherein the cavity has a length along the major axis and the second coupling groove extends along substantially the entire length of the cavity.

7. The electromagnetic filter of claim 1, further including a tuning screw extending into the cavity at the first coupling groove.

8. Microwave apparatus comprising:

an interior wall defining a substantially cylindrical cavity having a major axis and having an input for receiving electromagnetic energy which resonates in a given frequency band and supports first and second orthogonal modes of electromagnetic radiation;

wherein the interior wall includes a first coupling groove therein and a second coupling groove therein, the first coupling groove and second coupling groove disposed opposite one another and each having a predetermined depth for coupling electromagnetic energy between the first and second modes of electromagnetic radiation, and providing a symmetric filter function about a center frequency having a passband bandwidth proportional to the depth of the first and the second coupling grooves.

* * * * *